US005360954A

United States Patent [19]

Brüggeman et al.

[11] Patent Number: 5,360,954

[45] Date of Patent: Nov. 1, 1994

[54] PUSH BUTTON SWITCH

[75] Inventors: Ulrich Brüggeman, Heustreu; Hans-Karl Heil, Wildflecken; Gerhard Hochgesang, Bad Neustadt/Saale, all of Germany

[73] Assignee: Preh-Werke GmbH & Co. KG, Saale, Germany

[21] Appl. No.: 183,426

[22] Filed: Jan. 19, 1994

[30] Foreign Application Priority Data

Jan. 19, 1993 [DE] Germany ..... 4301192

[51] Int. Cl.[5] ..... H01H 3/42

[52] U.S. Cl. ..... 200/524; 200/523; 200/447; 200/449

[58] Field of Search ..... 200/524, 523, 447, 449, 200/450, 457, 529

[56] References Cited

U.S. PATENT DOCUMENTS 2,918,544 12/1959 Koenig ..... 200/447
4,543,459 9/1985 Hayashida ..... 200/524
5,280,148 1/1994 Cummins ..... 200/524

FOREIGN PATENT DOCUMENTS 1590503 11/1970 Germany .
2031364 1/1972 Germany .
2839108 3/1980 Germany .
3150046A1 7/1983 Germany .
3644437 5/1988 Germany .
91011264 7/1992 Germany .

*Primary Examiner*—Henry J. Recla
*Assistant Examiner*—David J. Walczak
*Attorney, Agent, or Firm*—Griffin Butler Whisenhunt & Kurtossy

[57] ABSTRACT

A push button switch, particularly a master switch, has housing-affixed contacts (4, 5) and a contact bridge (8) for bridging the contacts, with the bridge being moved by a spring plunger (10). A spring-switching mechanism (24, 25, 26) is operatively coupled between the spring plunger and a manually-movable sliding switch, or switch actuator, (22). The sliding switch (22) is engaged by a guiding, or sliding, locking linkage (27, 28) to be alternately moved between "on" and "off" positions upon being pushed in. In order to prevent manual inadvertent actuation from leading to increased wear and operational uncertainty, a pair of interacting rubbing surfaces (18, 19) is provided between the spring plunger (10) and a housing-affixed part (2) which provides an increased rubbing, or friction, between the spring plunger (10) and the housing-affixed part (2) shortly before an over-center snapping of the spring-switching mechanism (24, 25, 26) to thereby retard, or delay, a snapping movement of the spring plunger (10).

12 Claims, 4 Drawing Sheets

PUSH BUTTON SWITCH

BACKGROUND OF THE INVENTION

This invention concerns a push button switch, particularly, a master, or power, switch, having: housing-affixed contacts and at least one contact bridge for bridging the contacts that is movable by means of a spring plunger; an over-center spring-switching mechanism that is operatively coupled between the spring plunger and a manually-movable sliding switch; and a sliding locking linkage for the sliding switch for alternately locking the sliding switch in the "on" and "off" positions.

Such switches are often used for controlling electrical power to consumer appliances, particularly television-like devices.

German Auslegeschrift DE-AS 1 590 503 discloses such a push button switch. Experience has shown that such push button switches, in spite of their over-center spring switching mechanisms, can be manipulated in undesirable manners so that contact pressures are thereby influence. If, in such a switch, a switch button is not moved quickly enough, that is, it is moved very slowly and/or is only partly shoved in, in spite of its over-center spring switching mechanism, it can happen that a contact pressure of a contact bridge lying on housing-affixed contacts will go to zero and this condition can be maintained manually. This creates an increase in contact resistance and consequently produces contact heating. An increase in contact wear is associated therewith. Further, an overheated push button switch can result whose functioning ability as well as life span is not only decreased but which also presents a fire hazard.

A similar push button switch is described in German Gebrauchsmuster DE-GM 91 01 126. With the device described in this publication a contact vibration, or bounce, is avoided. However, this switch also has the above described problems.

German Offenlegungsschrift DE 31 50 046 A1 describes a push button switch in which partially welded contacts are supposedly torn open by means of a separating mechanism. The above described problems are not overcome by this device.

In German Offenlegungsschrift DE 28 39 108 A1 a button snap switch is disclosed. In this device, a sliding switch must be moved in different directions for turning it on and off. In the switch of German Offenlegungsschrift DE 28 39 108 A1 arcs and contact vibrations are supposedly prevented. In this device, a latching apparatus is provided which blocks a spring plunger in its two end positions and which is releasable by movement of the sliding switch. However, undesired manipulations are possible with this switch which cause the above mentioned problems to occur.

Another push button switch is described in German Offenlegungsschrift DE 20 31 364 A1. Also, in this device a sliding switch does not alternately engage upon each pushing thereof in "on" and the "off" positions. In order to achieve a snapping operation, a member coupled to a snapping spring is shoved over a cam.

German patent DE 36 44 437 C1 discloses a push button switch with an interengaging apparatus having a detent, or groove, and an engaging finger as a locking apparatus. In order to compensate for undue demands placed on its manipulated member in an activation direction, the locking apparatus is held by means of a spring in a shiftable position.

It is an object of this invention to provide a push button switch of the type mentioned in the first paragraph of the "BACKGROUND OF THE INVENTION" above in which an improper manual manipulation cannot easily lead to increased wear and to operational uncertainty.

SUMMARY

According to principles of this invention the above object of the invention is achieved with a push button switch having a pair of interacting rubbing surfaces between the spring plunger and a housing-affixed part, with the interacting rubbing surfaces being positioned and arranged so that an increase in interactive rubbing friction between the spring plunger and the housing-affixed part occurs shortly before an over-center snapping of the spring-switching mechanism caused by a shoving of the sliding switch so that the snapping movement of the spring plunger is retarded.

BRIEF DESCRIPTION OF THE DRAWINGS

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
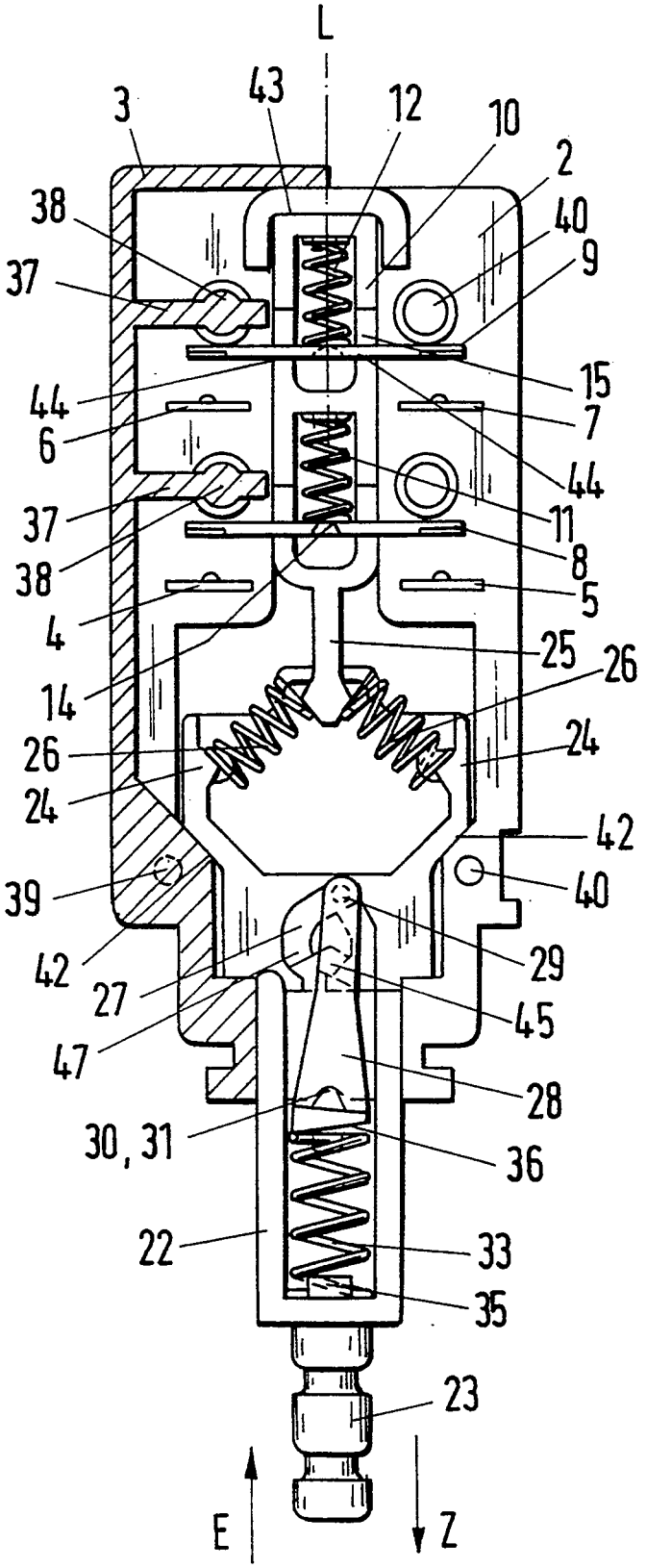
FIG. 1 is a cutaway, partially sectional, side view of a push button switch of this invention in an "off" position.

A housing 1 of a push button switch has a floor, or frame, part 2 and a cover 3. Two pairs of contacts 4, 5 and 6, 7 are attached to the floor part 2. Each contact pair 4, 5 and 6, 7 is respectively facing a contact bridge 8, 9. Basically, the push button switch 1 is a two-pole switch.

A spring plunger 10 is slidably mounted on the floor part 2 to be slidable in a direction of a length axis L. The spring plunger 10 has two chambers in which compression springs 11, 12 are mounted. These are respectively supported, or attached at one end by a lug 13 of the respective chamber and at the other end by one of the contact bridges 8, 9. The contact bridges 8, 9 have, for this purpose, an impression, or protrusion, 14. The contact bridges 8, 9 extent on each side of the length axis L through openings 15 in the spring plunger 10, in which they have play, or clearance.

An elastic spring tongue 16 is formed on the spring plunger 10 which interacts with a protrusion 17 of the floor part 2 in a manner which is described in more detail below. A first inclined surface 18 of the protrusion 17 and a first inclined surface 19 of the tongue 16 form a first rubbing surface pair. A second incline surface 20 of the protrusion 17 and a second inclined surface 21 of the tongue 16 form a second rubbing surface pair (compare FIGS. 1 and 2).

A sliding switch, switch actuator, switch button, or shover, 22 is slidably positioned on the floor part 2 to be slidable in a direction of the length axis L, to extend outside of the housing 1 in a direction of the length axis L, and to form, outside of the housing 1, a receiving plug, or mount, 23 for a push button which is not shown in any further detail.

The switch actuator 22 has an arm 24 on each side of the length axis L. Between each arm 24 and an extension 25 of the spring plunger 10 is arranged a compression, or expanding, spring 26. In this manner a snapping switch mechanism is formed between the spring plunger 10 and the switch actuator 22.

A somewhat heart-shaped groove, or track, 27 is formed on the switch actuator 22 which serves as a guide for a follower lever 28. The follower lever 28 engages with its hexagonal peg 29, hexagonal as seen in profile or cross section, in the groove 27. On an exterior end of the floor part 2 a rounded notch 30 is provided in which a rounded boss 31 of the follower lever 28 engages. The follower lever 28 has, in addition, facing away from the floor part 2, a boss, or shoulder, 32 which engages with an expanding spring 33 which simultaneously serves as a return spring 33 for the switch actuator 22. The return spring 33 lies in a chamber 34 of the switch actuator 22 and is held therein by a protrusion 35.

Figure 3:
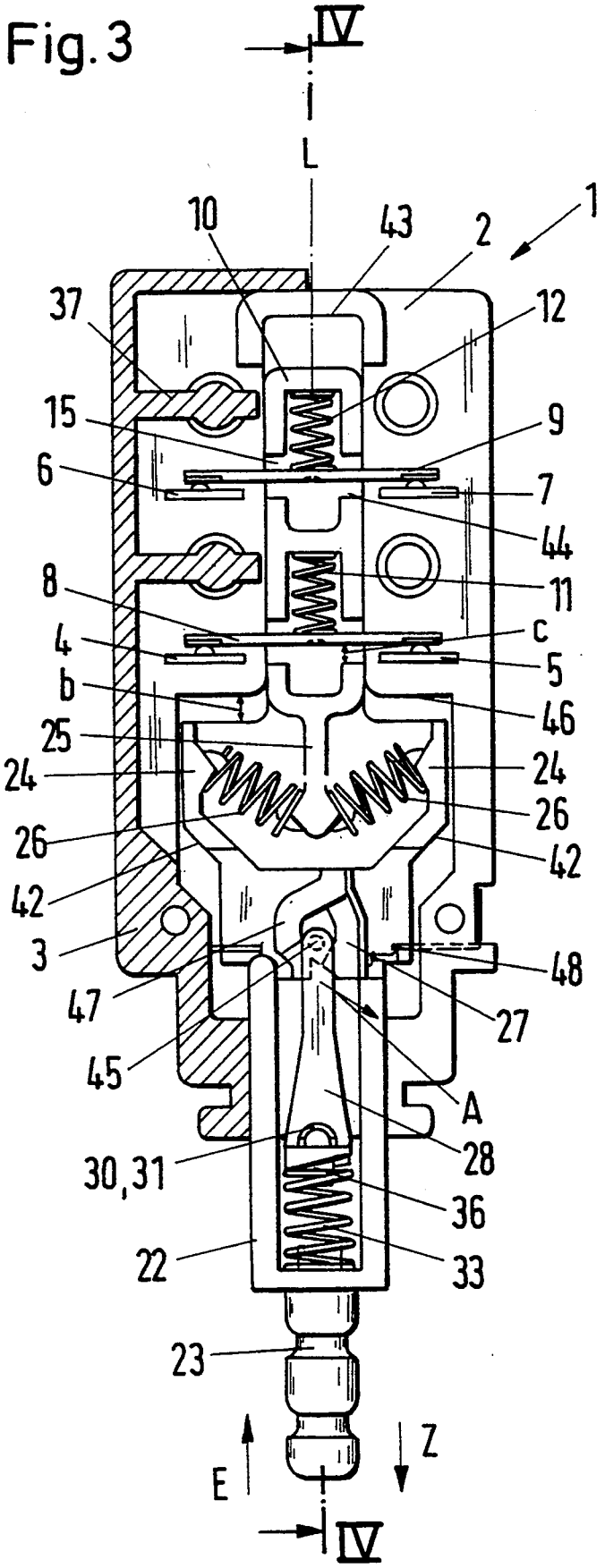
FIG. 3 is a view similar to FIG. 1, but with the push button switch in an "on" position.

The follower lever 28 has on its end facing the return spring 33 an incline surface 36 so that the follower lever has a tendency, at the mounting notch 30, to preferably swing with its hexagonal peg 29 to the right, as seen in FIGS. 1 and 3.

The described push button switch is mechanically uncomplicated to assemble. In this regard, all parts can be inserted from the same side (as seen in FIG. 1 from a direction perpendicular to the plane of the drawing and in FIG. 2 from a direction perpendicular to the relatively flat floor part 2). Also, the described springs can be relatively easily mechanically assembled. The cover plate 3 which is only shown to the left of the length axis in FIGS. 1 and 3, is mounted from the same direction. Lugs 38 and 39 formed on ribs 37 of the corner plate 3 engage thereby in bores 40 of the floor part 2. A lower surrounding edge 41 of the floor part 2 provides a receiving, or contact, surface for a circuit board that is not shown in further detail, to which the contacts 4 through 7 can be coupled. The contacts 4 through 7 lie protected within the edge 41 so that no outside particles can reach the contacts 4 through 7.

Figure 2:
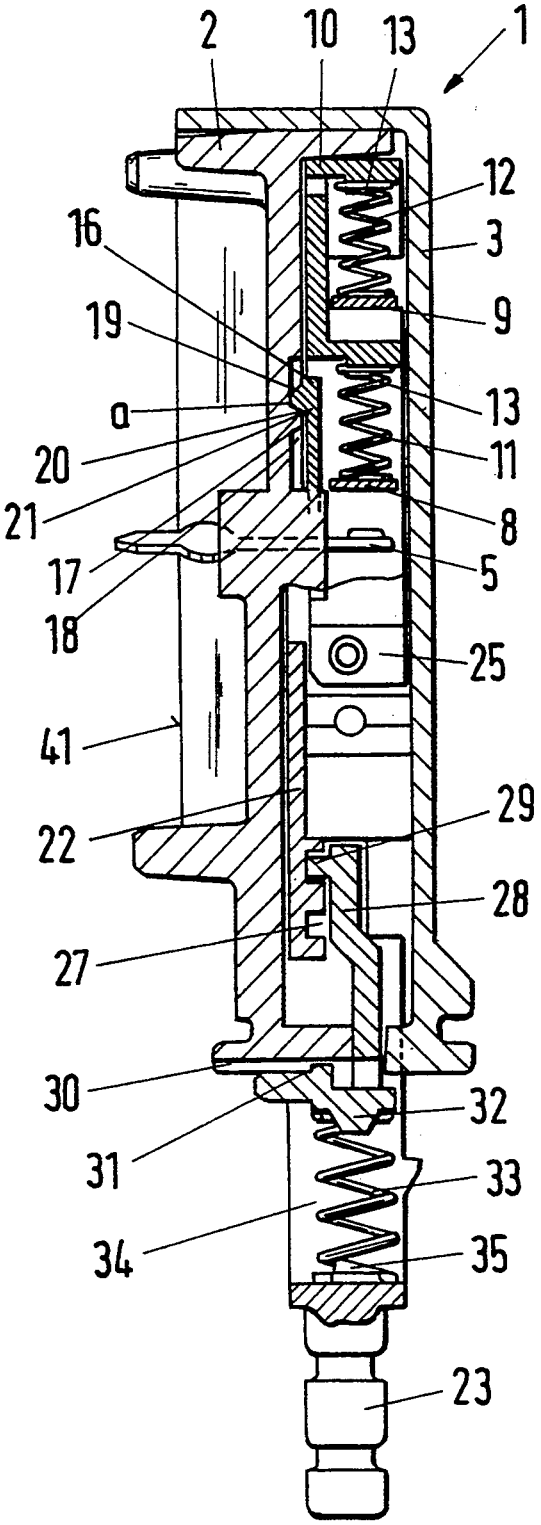
FIG. 2 is a view taken with the push button switch of FIG. 1 being rotated about is longitudinal axis 90° and shown partially in cross section and partially cut away.

Operation of the described push button switch is substantially as follows:

When the push button switch is in the "off" position depicted in FIGS. 1 and 2 the switch actuator 22 is urged, by means of the return spring 33, against stops 42. The expanding springs 26 are relatively relaxed and the spring plunger 10 is urged by these springs against a stop 43. The compression springs 11, 12 urge the contact bridges 8, 9 against edges 44 defining the openings 15. The contact bridges 8, 9 are thereby spaced from the contacts 4, 5 and 6, 7.

If it is desired to switch the push button switch the switch actuator 22 is then shoved in the depressing direction E. A guiding portion 47 of the groove 27 slides along the peg 29 of the follower lever 28. When the switch actuator 22 is depressed the expanding springs 26 are compressed, or tensioned, until they pass over a center point. Until that point, the spring plunger 10 remains unmoved. After the over-center point has been passed, the expanding springs 26 operate in a opposite direction so that the spring plunger 22 is now urged in a direction opposite the depressing direction E. After a sudden first freeing stroke movement "a" (see FIG. 2), the second inclined surface 21 of the tongue 16 engages with the second inclined surface 20 of the protrusion 17 whereby the inclined surfaces now frictionally lie against one another as rubbing surfaces. These rubbing surfaces now glide on one another causing a swinging, or giving, of the tongue 16, whereby movement of the spring plunger 10 is braked so that the contact bridges 8 and 9, then braked, come into engagement with the contacts 4, 5 and 6, 7. In this manner, a contact vibration, or bounce, is avoided or at least reduced. After the contact bridges 8 and 9 have made contact with the contacts 4, 5 and 6, 7, the spring plunger 10 moves only so far further that the edges 44 defining the openings 15 are spaced from the contact bridges 8 and 9. The contact pressure is now guaranteed by the compression springs 11 and 12.

Figure 4:
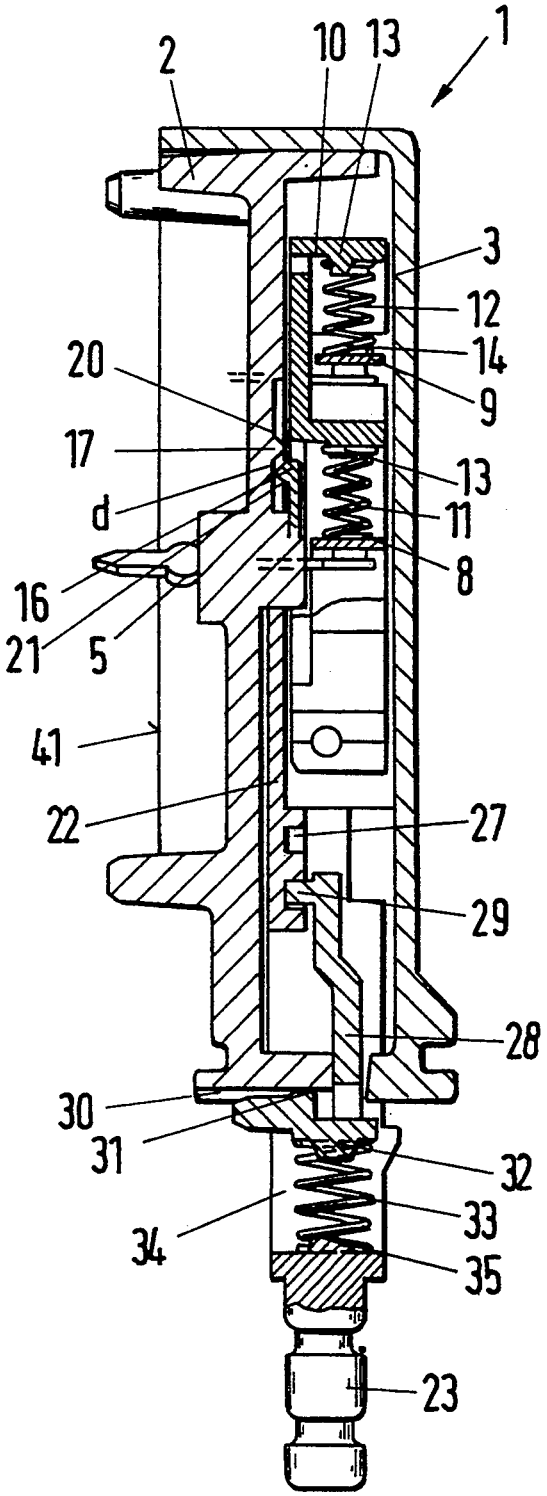
FIG. 4 is a mostly cross-sectional, but partially cutaway, view taken on line IV—IV in FIG. 3.

When the switch actuator is released, the peg 29 of the follower lever 28 goes into an engaging receiver, or notch, 45 of the groove 27. The push button switch is now in the "on" position shown in FIGS. 3 and 4.

If during a switching operation the switch actuator 22 and its push button were strongly pulled in a pull direction Z in a manner not intended, then, for switches in the prior art, the guiding apparatus, namely, the groove 27 or the follower lever 28 would be damaged. However, if in the described push button switch the switch actuator 22 were pulled in the direction Z, then the groove 27 carries the follower lever 28 in the direction Z. This is possible because the follower lever 28, in this direction Z, is not supported by the housing 1 but rather is supported by the return spring 33. The switch actuator 22 therefore allows movement in the pull direction Z. If, upon such a manipulation of the switch actuator 22, it is moved so far that it engages at the stops 42, then the spring plunger snaps by means of the expanding springs 26 of the spring-switching mechanism out of the "on" position into the "off" position, as is further described below.

For normally switching the push button switch from the "on" position to the "off" position, the switch actuator 22 is depressed in the direction E. When this is done, the groove 27 guides the peg 29 of the follower lever 28 so that the peg 29 leaves the engaging receiver 45, under operation of the expanding return spring 33 acting on the inclined surface 36, in a direction of an arrow A (see FIG. 3). After a short sudden stroke b, which only must be so large that the peg 29 of the follower lever 28 moves out of the engaging receiver 45, the switch actuator 22 engages an edge 46 of the floor part 2. Until this point, the spring plunger 10 is unmoved and, by means of the expanding springs 26 is held so that the compression springs 11, 12 maintain the necessary contact pressure between the contact bridges 8,9 and the contacts 4, 5 and 6, 7.

The switch actuator 22 is then released, or also manipulated to be slowly guided back in a manner not desired. In either case, it moves under force of the return spring 33, in the direction Z. When this is done, the expanding springs 26 come under increased compression until they pass a "center point". Already shortly before the center point is reached the spring plunger 10 begins to move in the direction E. Because of the clearance c between the frames 44 and the contact bridges 8, 9, the contact bridges 8, 9 do not yet contact the edges 44. Between the first inclined surface 18 of the protrusion 17 and the first inclined surface 19 of the tongue 16 there is a clearance d when the switch is in the "on" position, which is smaller than the clearance c. The inclined surfaces 18, 19, which serve as rubbing surfaces, therefore, come into contact before the edges 44 make contact with the contact bridges 8, 9. The rubbing surface pairs of the first inclined surfaces 18, 19 cause a delay, or retarding, of snapping movement of the spring plunger 10 and the contact bridges 8, 9. Only after the rubbing surfaces of the first inclined surfaces 18, 19 have glided across one another, during which the spring-loaded tongue 16 pivots and during which the tension force of the expanding springs 26 increases, the edges 44 of the spring plunger 10 engage the contact bridges 8, 9, whereby the inclined surfaces 18, 19 have released from one another. The contact bridges 8, 9 separate abruptly from the contacts 4, 5. The push button switch arrives at the "off" position depicted in FIGS. 1 and 2.

However, before the snapping point is reached, in which the contact bridges 8, 9 release from the contacts 4, 5 and 6, 7, in a jerked, sudden manner, a user can manipulate the switch actuator 22 without thereby bringing the contact bridges into positions in which they do not have sufficient contact pressure on the contacts 4, 5 and 6, 7. If the switch actuator, for example, is manipulated to an intermediate position in which the inclined surfaces 18, 19 already lie against one another and the expanding springs 26 are in the area of their over-center points, then there is thereby no dangerous increase of a transition contact electrical resistance between the contact bridges 8, 9 and the contacts 4, 5 and 6, 7, and also there is no danger of manipulated arcs being produced.

While the invention has been particularly shown and described with reference to a preferred embodiment, it will be understood by those of ordinary skill in the art that various changes in form and detail may be made therein without departing from the spirit and scope of the invention.

The inclined surface 19, which is parallel to the inclined surface 18, and the inclined surface 21, which is parallel to the inclined surface 20, can have various angles of inclination which are adapted to the described manner of operation. Normally, the inclined surfaces 18, 19 have steeper, or greater, inclination angles than the inclined surfaces 20, 21 because the inclined surfaces 18, 19 serve to enhance operation of the expanding springs 26 as force storing members and the inclined surfaces 20, 21 only operate as brakes.

It is convenient in this invention that the tongue 16 in the "on" position as well as in the "off" position—i.e. for most of the time—is not loaded and is only deflected during a switching operation. It is also possible to form the spring-loaded tongue 16 on the floor part 2 and to provide the protrusion 17 on the spring plunger 10.

The rubbing surface pairs 18, 19; 20, 21 can be also formed so that they are not inclined to the depressing direction E but rather so that they lie parallel thereto. A spring-loaded element would not be necessary if this were the case. The surfaces which would lead to an increased friction could then have appropriate surface structures.

It could also be provided that the follower lever 28 is mounted in the floor part 2. It would then be engaged by means of an auxiliary spring which makes possible its removal upon a movement in the pulling direction Z. Opposite to the described structure, it is also possible for the follower lever 28 to be mounted on the switch actuator 22 and to provide the groove 27 on the floor part 2. If the follower lever 28 does not release upon a movement of the switch actuator upon a pulling in the pulling direction Z, the groove can be so mounted that it follows movement of the follower lever 28.

In FIG. 3 a further switching contact 48 is shown. This contact serves to signal the respective switch position of the push button switch.

It will be understood by those of ordinary skill in the art that springs of the spring-switching mechanism go through compression upon movement of the switch actuator. When the spring plunger begins to move it is braked, or held by the frictionally-rubbing rubbing surface pair before it reaches its transition point, whereby a necessary contact pressure is maintained. The transition point is thereby first reached at a stronger tensioned position of the springs than if the desired retarding or delaying of the movement of the spring plunger, before the transition point, were not there; the spring plunger thereby also passes through the transition point quicker. Because of this, an improper manipulation of the switch actuator at the transition, or over-center, point, hardly causes any influence on the contact pressure. That is, there is no danger that the switch actuator can be manipulated to positions, and/or can be blocked, so as to increase contact transition electrical resistances or to cause electric arcs which can lead to overheating and undue wearing or fire hazards associated therewith.

In the above-described preferred embodiment of the invention, a further pair of interacting rubbing surfaces is provided between the spring plunger and the housing-affixed part. In this manner, movement of the spring plunger before engagement of the contact bridges with the housing-affixed contacts can be braked, whereby a vibration, or jumping, of the contacts is suppressed.

The embodiments of the invention in which an exclusive property or privilege are claimed are defined as follows:

1. A push button switch having housing-affixed contacts, at least one contact bridge for bridging the contacts that is movable by means of a spring plunger, an over-center spring-switching mechanism that is operatively coupled between the spring plunger and a manually-movable sliding switch, and a locking linkage for interconnecting the sliding switch with said spring switching mechanism for alternately locking the sliding switch in the "on" and "off" positions;

wherein a pair of interacting rubbing surfaces is provided between the spring plunger and a housing-affixed part, with the interacting rubbing surfaces being positioned and arranged so that an increase in interactive rubbing friction occurs between the spring plunger and the housing-affixed part shortly before a snapping of the spring-switching mechanism caused by a shoving of the sliding switch occurs so that a snapping movement of the spring plunger is retarded.

2. A push button switch as in claim 1 wherein a first rubbing surface of the pair of interacting rubbing surfaces is a first inclined surface affixed to the housing and the other rubbing surface of the pair of interacting rubbing surfaces is a first inclined surface of a spring-loaded tongue of the spring plunger, whereby the first inclined surfaces engage one another when the spring plunger is depressed to change the push button switch from an "on" position to an "off" position.

3. A push button switch as in claim 2 wherein there is included a further pair of interacting rubbing surfaces between the spring plunger and the housing-affixed part which brakes movement of the spring plunger before an "on" position is achieved.

4. A push button switch as in claim 3 wherein a rubbing surface of the further pair of interacting rubbing surfaces is a second inclined surface of the housing-affixed part and the other surface of the further pair is a second inclined surface of the spring-loaded tongue of the spring plunger, whereby the second inclined surfaces engage one another upon shoving the spring plunger from the "off" position to the "on" position of the push button switch.

5. A push button switch as in claim 4 wherein the first inclined surfaces are steeper than the second inclined surfaces.

6. A push button switch as in claim 4 wherein the first inclined surface and the second inclined surface of the housing-affixed part form sides of a protrusion of the housing-affixed part and the first inclined surface and the second inclined surface of the spring-loaded tongue are on the same spring-loaded tongue of the spring plunger.

7. A push button switch as in claim 3 wherein the pair of interacting rubbing surfaces retard movement of the spring plunger to a greater degree than the further pair of interacting rubbing surfaces.

8. A push button switch as in claim 1 wherein in one of the "on" and "off" positions of the spring plunger there is a clearance between the members of the pair of interacting rubbing surfaces.

9. A push button switch as in claim 1 wherein in the "on" position of the spring plunger there is a clearance between an edge of the spring plunger and the at least one contact bridge whereby the edge of the spring plunger moves the contact bridges from the "on" position to the "off" position.

10. A push button switch as in claim 9 wherein the clearance is larger in the "on" position than is a second clearance between the interacting rubbing surfaces in the "on" position.

11. A push button switch as in claim 1 wherein the contact bridge is supported on the spring plunger with a compression spring.

12. A push button switch as in claim 1 wherein is further included a guiding linkage apparatus comprising a member forming a guiding track and a follower mounted on a follower lever for engaging the track including means for allowing both the follower and track, upon a manual pulling force, opposite to a depressing force, being applied to the switch actuator, to move in the direction of the pulling force.

* * * * *